US005180537A

United States Patent [19]

Grand et al.

[11] Patent Number: 5,180,537

[45] Date of Patent: Jan. 19, 1993

[54] METHOD OF CONTINUOUSLY CASTING A LIQUID METAL USING STREAM PROTECTION TUBE

[75] Inventors: Jean-Paul Grand, Miramas; Daniel Juvigny, Pelissanne; André Vinuesa, Mallemort; Serge Tortosa, Martigues, all of France

[73] Assignee: Sollac, Puteaux, France

[21] Appl. No.: 751,831

[22] Filed: Aug. 29, 1991

[30] Foreign Application Priority Data

Aug. 30, 1990 [FR] France ..... 90 10829

[51] Int. Cl.[5] ..... B22D 41/50

[52] U.S. Cl. ..... 266/45; 222/590; 222/606

[58] Field of Search ..... 266/236, 45; 222/590, 222/606, 607

[56] References Cited

U.S. PATENT DOCUMENTS 3,459,346 8/1969 Tinnes ..... 222/606
4,510,191 4/1985 Kagami et al. ..... 222/606
4,887,748 12/1989 Hicks ..... 222/606

*Primary Examiner*—Scott Kastler

*Attorney, Agent, or Firm*—Cushman, Darby & Cushman

[57] ABSTRACT

A method of continuously casting a liquid metal including the steps of providing an upper vessel and a lower vessel, providing a stream protection tube disposed between the upper vessel and the lower vessel, the stream protection tube being connected at an upper end thereof to a tap hole defined in a bottom portion of the upper vessel, the stream protection tube being open at a lower end thereof, at least one aperture being defined in a wall of the tube near the lower end. The method further includes disposing the upper vessel above the lower vessel, lowering the upper vessel until a lower portion of the tube disposed below the aperture is immersed in liquid metal contained in the lower vessel with the aperture being disposed above the liquid metal. Next, the tap hole is opened so that liquid metal disposed in the upper vessel flows into the stream protection tube, air contained in the tube is expelled through the aperture. The stream protection tube is then lowered into the lower vessel until the aperture is completely immersed in the liquid metal contained in the lower vessel. Finally, casting of metal from the upper vessel to the lower vessel is continued.

3 Claims, 2 Drawing Sheets

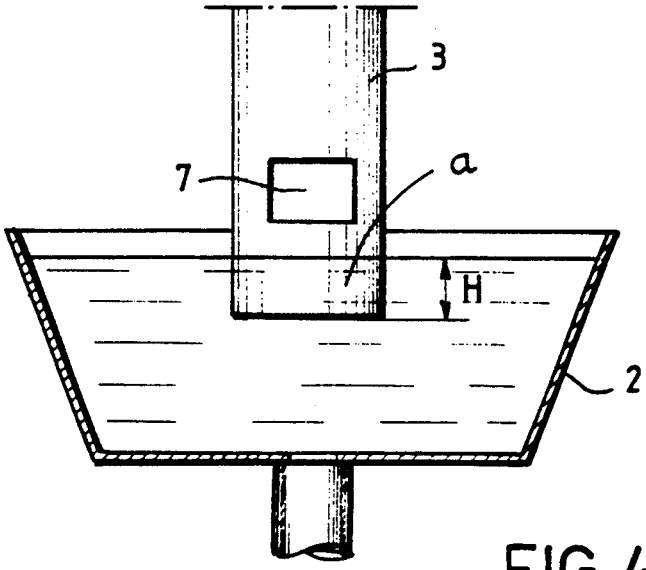
FIG.4
FIG.5
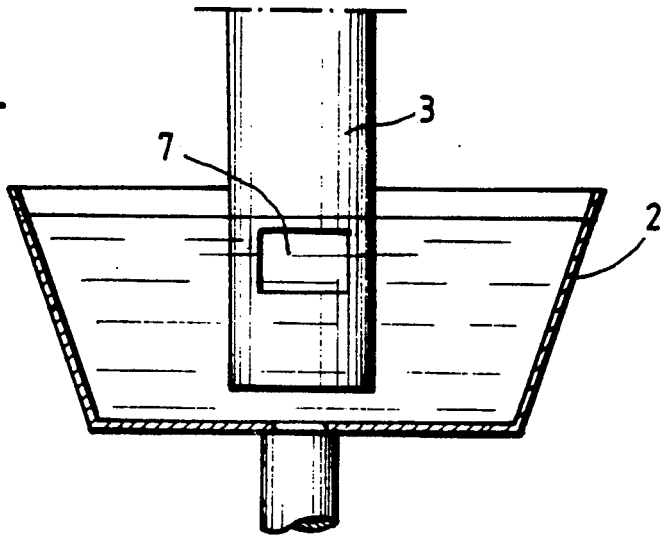

METHOD OF CONTINUOUSLY CASTING A LIQUID METAL USING STREAM PROTECTION TUBE

The present invention relates to a stream protection tube located between the casting ladle and the tundish of liquid metal of a continuous casting installation and a continuous casting process employing such a tube.

In continuous casting installations, the flow of the liquid metal between the casting ladle and the tundish is effected by passage in a stream protection tube. This tube, fixed to the end of the tap hole of the ladle, is immersed in the tundish in order to guide the stream, to prevent renitriding of the steel and its oxidation due to it coming into contact with the air, and to prevent the entrainment of dross and slag present on the surface of the liquid metal contained in the tundish, either towards the bottom, due to the emulsion created by the falling of the metal from the casting ladle towards the tundish, or towards the outside of the tundish due to possible splashes caused by the fall.

The problem posed is as follows:

the lower part of the stream protection tube is immersed in the liquid metal contained in the tundish before the opening of the tap hole of the ladle. In this case, upon opening of the said tap hole, the liquid metal in the ladle descends into the tube, compressing the air which was trapped therein.

As soon as the pressure exerted on the air by the metal descending in the tube reaches a sufficient level, the air escapes violently inside the tundish, creating a veritable mini explosion.

This mini explosion causes, an oxidation of the bath contained in the tundish and, splashes liquid metal, which represents a real danger to personnel, and, in certain cases, uncoupling of the tube and of the tap hole or fracturing of the stream protection tube due to the considerable shock wave which is created, in which case the tap hole of the ladle has to be reclosed and the entire installation has to be shut down in order to replace the tube.

Another problem occurs when the tap hole of the ladle is open whilst the end of the stream protection tube is not in contact with the liquid metal contained in the tundish, the said tube being lowered into the tundish in a second stage after the metal has reached its lower end.

In this case, the air contained in the tube escapes above the bath of the tundish and it is only when the liquid metal in the ladle appears that the tube is immersed in the bath of the tundish. This solution, however, presents a drawback due to the high density of the liquid metal and of the considerable height, almost 2 m, between the casting ladle and the tundish. The liquid metal in the tube comes into contact with the bath of the tundish with a high kinetic energy and the impact of the fall also gives rise to many splashes and mechanical stirring of the bath, entraining, towards the bottom, dross and slag present on the surface of the bath.

Moreover, a part of the stream is not protected and is in contact with the ambient air, which gives rise to oxidation of the liquid metal in this unprotected part.

The subject of the invention is a stream protection tube for a continuous casting installation which makes it possible to remedy these drawbacks, as well as a continuous casting process employing such a tube.

It relates more particularly to a stream protection tube of a continuous casting installation, characterised, particularly, in that the lower end of this tube is equipped with at least one aperture or opening for the air to escape.

A further subject is a casting process employing such a tube and characterised in that:

- the casting ladle is brought above the tundish and this ladle is lowered until a lower portion of the tube, located below the lowest aperture, is immersed in the metal contained in the tundish;
- the tap hole is opened, the liquid metal descends into the tube and the air contained in the tube, pushed by the metal, is evacuated above the tundish via the apertures, whilst the stream protection tube continues to be lowered into the tundish until the apertures are completely immersed in the bath of the tundish;
- lowering of the tube is stopped as soon as the apertures are completely immersed in the bath of the tundish and casting of the entire ladle is continued under these conditions.

BRIEF DESCRIPTION OF THE DRAWINGS

The invention will be described in greater detail hereinbelow with reference to the appended drawings which are given solely by way of example. In these drawings:

FIG. 4 is a view illustrating the position of the tube before opening of the tap hole of the ladle;

FIG. 5 is a view of the tube during casting.

Figure 1:
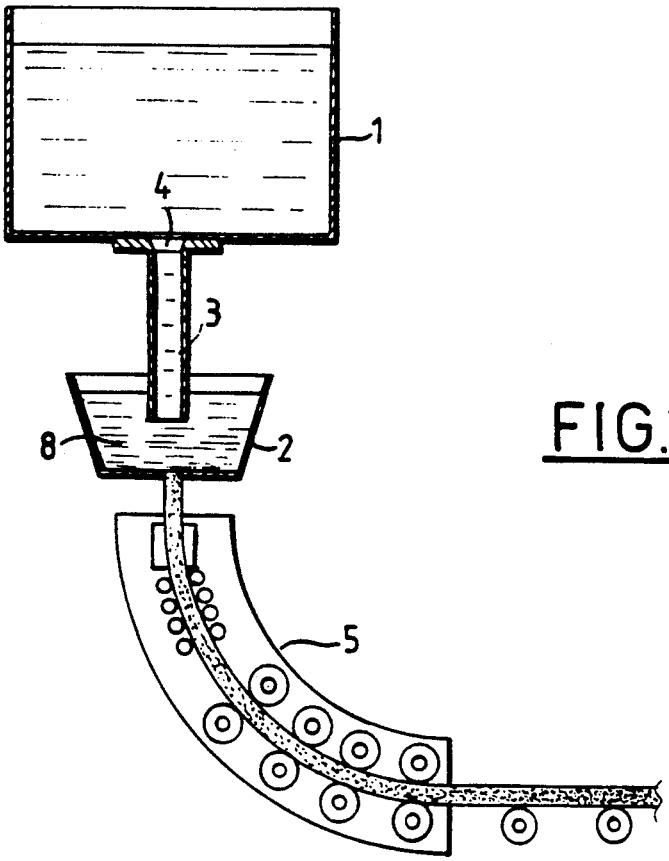
FIG. 1 is a diagrammatic view of a continuous casting installation.

A continuous casting installation is composed of a casting ladle 1 over a tundish or distributor 2. Between the casting ladle 1 and the tundish 2, the metal is guided via a stream protection tube 3.

The casting ladle 1, of known type, is equipped in its base with a circular tap hole 4, arranged in its centre in the illustrative embodiment shown.

The tundish 2, located under the casting ladle, is filled with a bath 8 of liquid metal and is equipped in its base with a hole connected in a known manner to a continuous casting line 5.

The stream protection tube 3 is a vertical tube of length L, and having a vertical axis that is coincident with a vertical axis of the tap hole 4 of the ladle 1.

The upper end of tube 3 is equipped with a device 6 enabling it to be fixed in a leaktight manner to the lower face of the base of the casting ladle 1, thus placing the tap hole 4 opposite the tube.

In the illustrative embodiment shown, the device is a support plate.

The tube 3 has, in its lower part opposite the end equipped with the device 6, at least one opening or aperture 7, of height h.

In the illustrative embodiment shown (FIG. 2), the tube has two apertures of rectangular shape disposed opposite one another in the same cross-section of the In the illustrative embodiment shown (FIG. 3), the tube has four apertures of circular shape distributed about a vertical axis thereof and located in the same cross-section of the tube 3.

Figure 2:
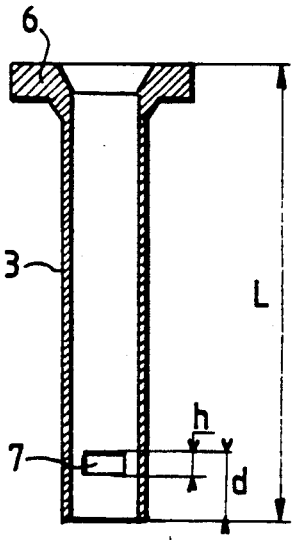
FIG. 2 is a longitudinal sectional view of a stream protection tube according to the invention.
Figure 3:
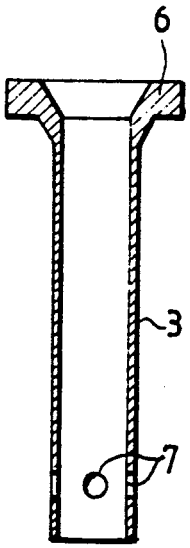
FIG. 3 is a longitudinal sectional view of another embodiment of a stream protection tube according to the invention.

Obviously, the tube may have apertures with geometric shapes other than those shown in FIGS. 2 and 3 and these may be disposed differently, for example four apertures of triangular shape distributed over the periphery of the tube and located in different sections or at different levels.

The distance d between the upper end of the aperture, is highest when the tube has several apertures disposed over different sections. The lower end of the stream protection tube 3 is at most equal to the ferrostatic overflow height of the tundish used, which is substantially equal to the height of the tundish. The continuous casting process in an installation equipped with a stream protection tube such as described hereinabove takes place as follows:

the ladle 1 is brought above the tundish 2 until the portion a of the tube, of height H which is less than d−h, is immersed in the metal contained in the tundish (FIG. 4), i.e. approximately a few centimeters from the lower end of the tube. The apertures are then disposed above the surface of the bath 8 contained in the tundish.

the tap hole 4 of the ladle 1 is opened and the liquid metal descends into the tube 3. The air contained in the tube, pushed by the metal, is evacuated above the tundish via the apertures 7.

During the descent of the metal, the stream protection tube continues to be lowered into the tundish at a speed V until the apertures 7 are completely immersed in the bath of the tundish (FIG. 5).

The descent speed V of the tube depends on the height of the tube, its section and the density of the metal being cast. It is chosen such that, when the first drop of metal arrives at the level of the apertures, the latter are about to be completely immersed in the bath of the tundish.

As soon as the apertures 7 are totally immersed in the bath of the tundish, lowering of the tube is stopped and casting of the entire ladle is effected under these conditions.

Thus the air contained in the tube is not compressed due to the thrust of the metal and escapes via the apertures 7.

When the metal arrives at the end of the tube, the end already being immersed in the tundish, there is no splashing and no stirring phenomenon in the bath.

The entire stream is protected during all stages of the process, which prevents the phenomena of oxidation of the metal at the level of the stream.

The objective sought is thus achieved efficiently and using particularly simple and inexpensive means.

What is claimed is:

1. A method of continuously casting a liquid metal comprising the steps of:

providing an upper vessel and a lower vessel;

providing a stream protection tube disposed between said upper vessel and said lower vessel, said stream protection tube being connected at an upper end thereof to a tap hole defined in a bottom portion of said upper vessel, said stream protection tube being open at a lower end thereof, at least one aperture being defined in a wall of said tube near said lower end;

disposing said upper vessel above said lower vessel;

lowering said upper vessel until a lower portion of said tube disposed below said at least one aperture is immersed in liquid metal contained in said lower vessel, said at least one aperture being disposed above said liquid metal, opening said tap hole so that liquid metal disposed in said upper vessel flows into said stream protection tube, air contained in said tube being expelled through said at least one aperture;

lowering said stream protection tube into said lower vessel until said at least one aperture is completely immersed in said liquid metal contained in said lower vessel; and continuing casting of metal from said upper vessel to said lower vessel.

2. A method according to claim 1, wherein said stream protection tube is lowered into said lower vessel at a speed such that said at least one aperture is about to be completely immersed when said liquid metal flowing into said stream protection tube arrives at the level of said at least one aperture.

3. A method according to claim 1, wherein a distance between an upper portion of said at least one aperture and said lower end of said stream protection tube is at most equal to a ferrostatic overflow height of said lower vessel.

* * * * *